United States Patent [19]

Miller

[11] Patent Number: 4,872,097

[45] Date of Patent: Oct. 3, 1989

[54] MINIATURE LOW-VOLTAGE LIGHTING FIXTURE

[76] Inventor: Jack V. Miller, 700 N. Auburn Ave., Sierra Madre, Calif. 91024

[21] Appl. No.: 279,961

[22] Filed: Dec. 5, 1988

[51] Int. Cl.[4] ..... H01R 33/49

[52] U.S. Cl. ..... 362/226; 362/365; 362/373

[58] Field of Search ..... 362/226, 147, 148, 364, 362/365, 373, 457, 458, 296, 341; 439/616

[56] References Cited

U.S. PATENT DOCUMENTS

| | | | |
|---|---|---|---|
| 2,664,551 | 12/1953 | Kuebler | 439/616 |
| 4,419,716 | 12/1983 | Koo | 362/373 |
| 4,459,648 | 7/1984 | Ullman | 362/226 |
| 4,566,057 | 1/1986 | Druffel | 362/365 |
| 4,613,931 | 9/1986 | Messinger | 362/373 |
| 4,729,080 | 3/1988 | Fremont et al. | 362/365 |
| 4,760,510 | 7/1988 | Lahti | 362/365 |
| 4,763,231 | 8/1988 | Houplain | 362/365 |
| 4,779,167 | 10/1988 | Nelson | 362/373 |

*Primary Examiner*—Ira S. Lazarus
*Assistant Examiner*—Richard R. Cole

[57] ABSTRACT

A lighting fixture includes a reflector lamp having a bulb, a reflector and a bayonet base, a lampholder for holding and connecting the lamp having a proximal end connected to an external source of electrical power and a distal end supporting the base of the lamp. A generally radial flange is contiguous with the distal end of the lampholder and supports a contiguous cylindrical bulb reflector housing coaxially with the lampholder and extends beyond the bulb reflector in the distal direction. The bulb reflector has one or more rotational engagement notches engageable with a tool for installation or removal of the bayonet base of the lamp from the lampholder. A preferred embodiment has a torsion spring is disposed about a screw installed in each of two threaded transverse holes, with the springs having legs resiliently biased towards the distal end of the fixture. The cylindrical bulb reflector housing extends beyond the bulb reflector and is provided with an external radial flange at its distal end; whereby the fixture may be installed in a hole in a ceiling panel that closely fits the bulb reflector housing and the legs of the torsion spring apply force to a top surface of the ceiling panel to pull the external radial flange against the bottom surface of the ceiling panel to retain the fixture in the panel.

7 Claims, 3 Drawing Sheets

MINIATURE LOW-VOLTAGE LIGHTING FIXTURE

BACKGROUND OF THE INVENTION

This invention relates to lighting fixtures for use in residential and commercial applications, and particularly to those fixtures that use miniature reflector lamps for precise control of the light beams. Presently available light fixtures for such applications are generally complex, such as is shown in U.S. Pat. No. 4,646,214, in which a lampholder is installed into one of three separate housings that comprise the fixture. A major reason for the separable housings is to provide access to the bulb. A step towards simplification was made in my U.S. Pat. No. 4,682,276 in which the lampholder is integral with the housing, but the housing requires radial clearance to grip the bulb reflector for removal or replacement of the lamp. A reflector for a lamp that requires virtually no radial clearance is shown in my co-pending design patent application Ser. No. 198,095.

A primary purpose of the present invention is to provide a simple and inexpensive one-piece structure for a lighting fixture for reflector lamps, in which the bulb may be easily removed and replaced without resorting to separable housing sections or excessive radial clearance for bulb access.

It is a further purpose of the present invention to provide a lighting fixture that is easily mounted in a ceiling panel with no loose parts or external supports.

SUMMARY OF THE INVENTION

The achievement of the foregong purposes of the invention are achieved by the present invention in which a miniature lighting fixture includes a reflector lamp having a bulb, a reflector and a bayonet base. The structure for the fixture includes an integral lampholder for holding and connecting the lamp, with a proximal end connected to an external source of electrical power and a distal end supporting the base of the lamp. A generally radial flange is contiguous with the distal end of the lampholder and supports a contiguous cylindrical bulb reflector housing coaxially with the lampholder and extending beyond the bulb reflector in the distal direction. A plurality of generally planar fins are integral with the lampholder, the radial flange and the cylindrical bulb reflector housing. The integral fins are parallel to the central axis of the lampholder and form a parallel plane on either side of the lampholder in which a threaded transverse hole is provided.

A preferred embodiment for recessed mounting has a torsion spring disposed about a screw in a threaded hole one each side of the fixture, with spring legs resiliently biased downwards. The housing is provided with an external radial flange at its distal end; whereby the fixture may be installed in a circular hole in a ceiling panel that closely fits the bulb reflector housing. The legs of the torsion spring are flexed upwards and the fixture body is slipped into the hole in the ceiling. The torsion springs arethen released to apply force to the top surface of the ceiling panel to pull the radial flange of the fixture upwards against the bottom surface of the ceiling panel to retain the fixture in the panel.

In another preferred embodiment the bulb reflector has one or more rotational engagement notches for installation or removal of the bayonet base of the lamp from the lampholder. An installation and removal tool engages the notches with planar vanes that are provided at one end of an elongated handle that permits installation or removal of the bulb from a ceiling-mounted fixture while standing on the floor.

DETAILED DESCRIPTION OF THE DRAWINGS

Figure 1:
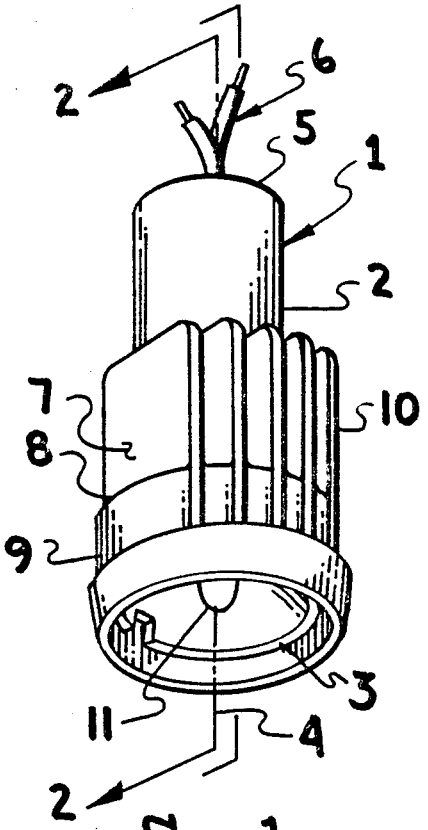
FIG. 1 is a pespective view of a preferred embodiment low-voltage lighting fixture according to the present invention.

In FIG. 1 a preferred embodiment of the low-voltage lighting fixture 1 has a lampholder 2 for holding and connecting a lamp 3 on a central axis 4. Lampholder 2 has a proximal end 5 having a means 6 for connection to a source of external electrical power, and a distal end 7 contiguous with a flange 8 which extends radially to a cylindrical lamp reflector housing 9 extending beyond the bulb reflector in the distal direction. A plurality of integral fins 10 are contiguous with the lampholder 2, the flange 8 and the cylindrical reflector housing 9. Lamp 3 is a miniature reflector lamp generally known as an "MR" type, and is provided with an exposed bulb 11.

Figure 2:
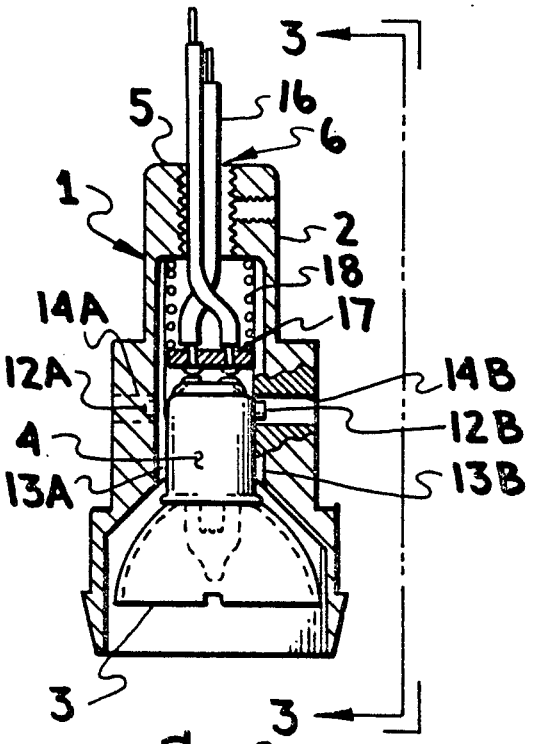
FIG. 2 is cross-sectional view of the fixture of FIG. 1, taken along section line 2—2.

In FIG. 2 fixture 1 is shown in cross section with lamp 3 having a conventional bayonet base provided with cross pins 12A and 12B axially slidable in channels 13A and 13B and rotated into a pair of recesses 14A and 14B which intersect the channels in a manner typical of bayonet base sockets. The means 6 for connection to a source of external power includes a insulated conductors 16 passing into the proximal end of lampholder 2 and connecting to a contact plate 17 axially slidable in channels 13A and 13B and resiliently urged into contact with the lamp base 4 by a spring 18.

Figure 3:
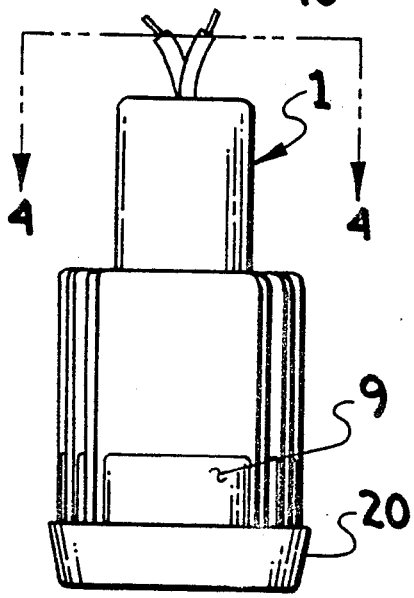
FIG. 3 is a side elevation view of the fixture, taken along line 3—3 of FIG. 2.

In FIG. 3 fixture 1 is shown with the generally cylindrical lamp reflector housing 9 having a radially extending flange 20.

Figure 4:
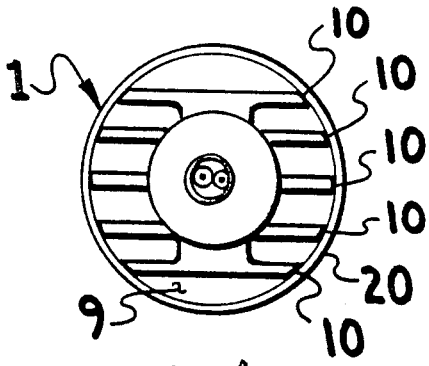
FIG. 4 is a top elevation view of the fixture, taken along line 4—4 of FIG. 3.

In FIG. 4 fixture 1 is shown with both the reflector housing 9 and cooling fins 10 having generally cylindrical surfaces terminating in the flange 20. The cooling fins are optional, based on the required cooling for higher lamp power applications.

Figure 5:
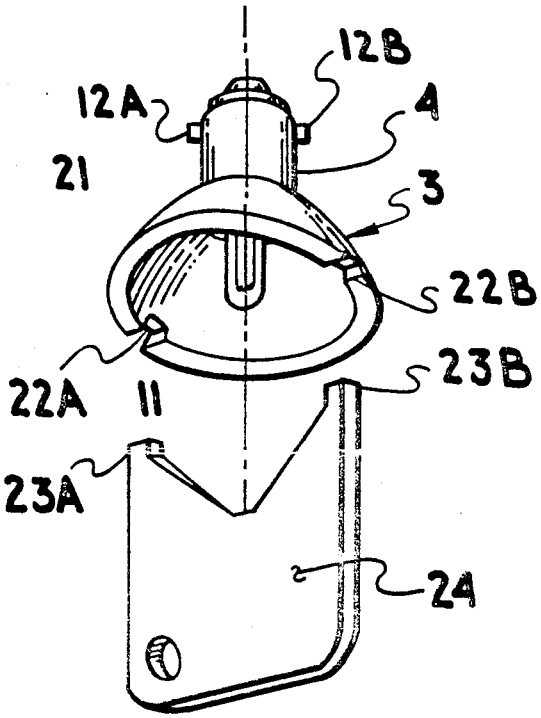
FIG. 5 is a perspective view of the bulb and a preferred embodiment of a bulb removal and installation tool.

In FIG. 5 lamp 3 is shown having a reflector 21 and bayonet base 4 with cross pins 12A and 12B and having a means for bulb installation and removal comprising a pair of notches 22A and 22B in the edge of reflector 21 and engageable with a pair of drive blades 23A and 23B on a key 24, whereby the bayonet base pins 12A and 12B may be rotated into engagement or out of engagement with the respective recesses 14A and 14B of the lampholder of FIG. 2.

Figure 6:
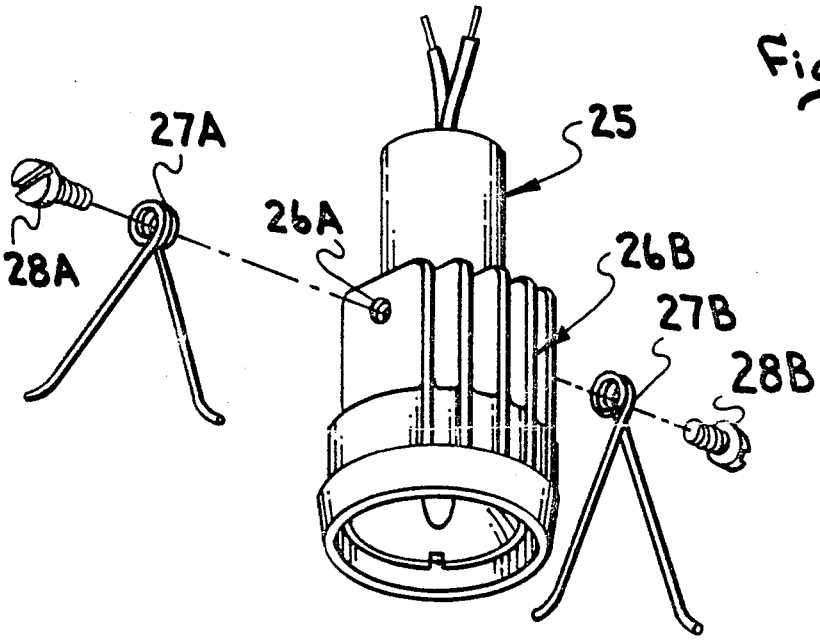
FIG. 6 is an exploded perspective view of an alternate embodiment of the fixture for recessed ceiling mounting.

FIG. 6 shows a preferred embodiment fixture 25 for recessed ceiling installation in which a threaded hole 26A is provided to secure a torsion spring 27A rotatable on a screw 28A on one side of the fixture, and another threaded hole 26B is provided to secure a torsion spring 27B rotatable on a screw 28B on the opposite side of the fixture. Torsion springs 27A and 27B are shown in a free condition. Screws are shown as one means of providing a pin for holding the torsion springs, but any other means, such as drive pins, integral bosses or rivets will provide an equivalent function.

Figure 7:
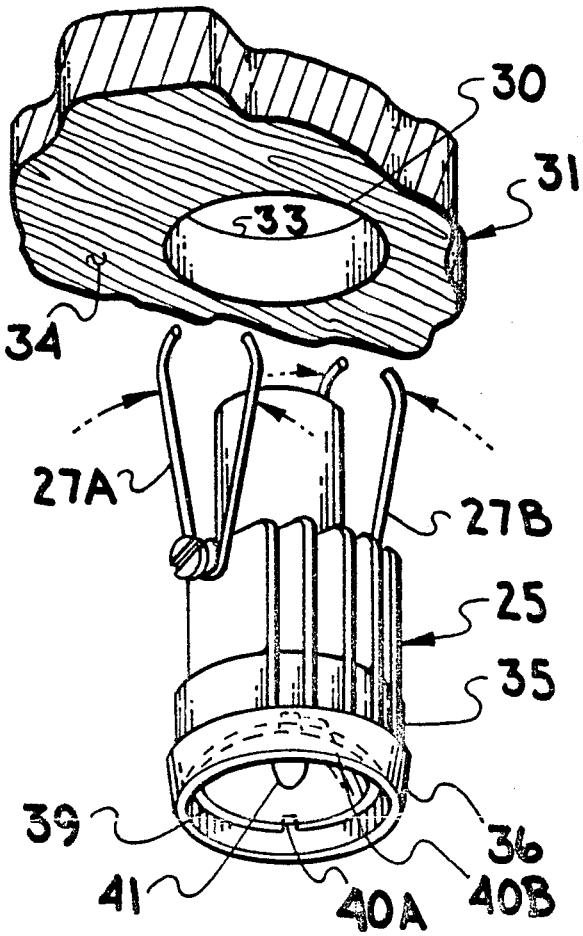
FIG. 7 is a perspective view of the fixture of FIG. 6, being installed in a ceiling.

In FIG. 7 fixture 25 is shown having torsion springs 27A and 27B torsionally loaded in the directions shown by the arrows to a dimension that will permit the springs to pass through a hole 30 in a ceiling panel which is large enough to permit the entry of the cylindrical reflector housing 31 of Fixture 25, but not large enough to accept the radial flange 32.

In FIG. 7 fixture 25 is shown installed into a generally circular hole 30 in a ceiling panel 31 having a top surface 33 and a bottom surface 34. Hole 30 is large enough to accept the cylindrical reflector housing 35, but is not large enough to accept radial flange 36. The internal structure of fixture 25 is identical to that of fixture 1 shown in FIG. 2, and fixture 25 is provided with a lamp 39 which is identical to the miniature reflector ("MR") lamp 3 of FIG. 2 and has an exposed bulb 41 and a pair of notches 40A and 40B.

Figure 8:
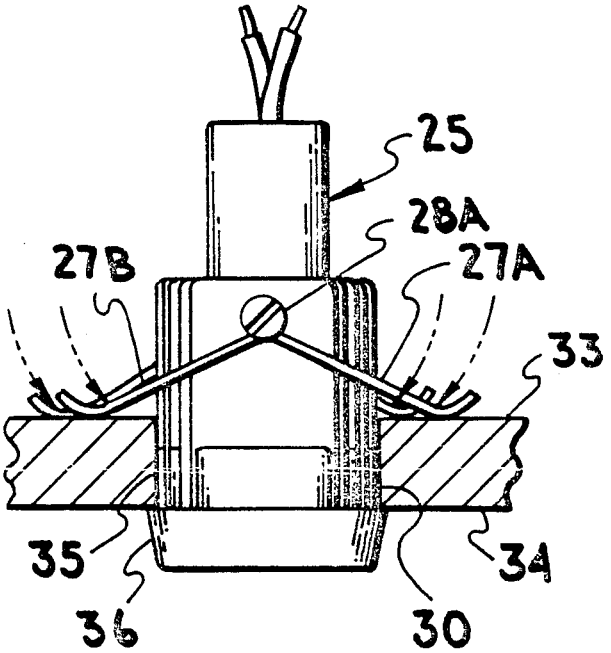
FIG. 8 is a side elevation view of the fixture of FIG. 7, shown installed recessed in a ceiling.

The installation of fixture 25 into the ceiling is shown in FIG. 8 in which housing 35 is disposed within hole 30 with flange 36 held tightly against bottom surface 34 of ceiling panel 31 by the urging of the torsion springs 27A and 27B in the direction shown by the arrows against top surface 33 of ceiling panel 31.

Figure 9:
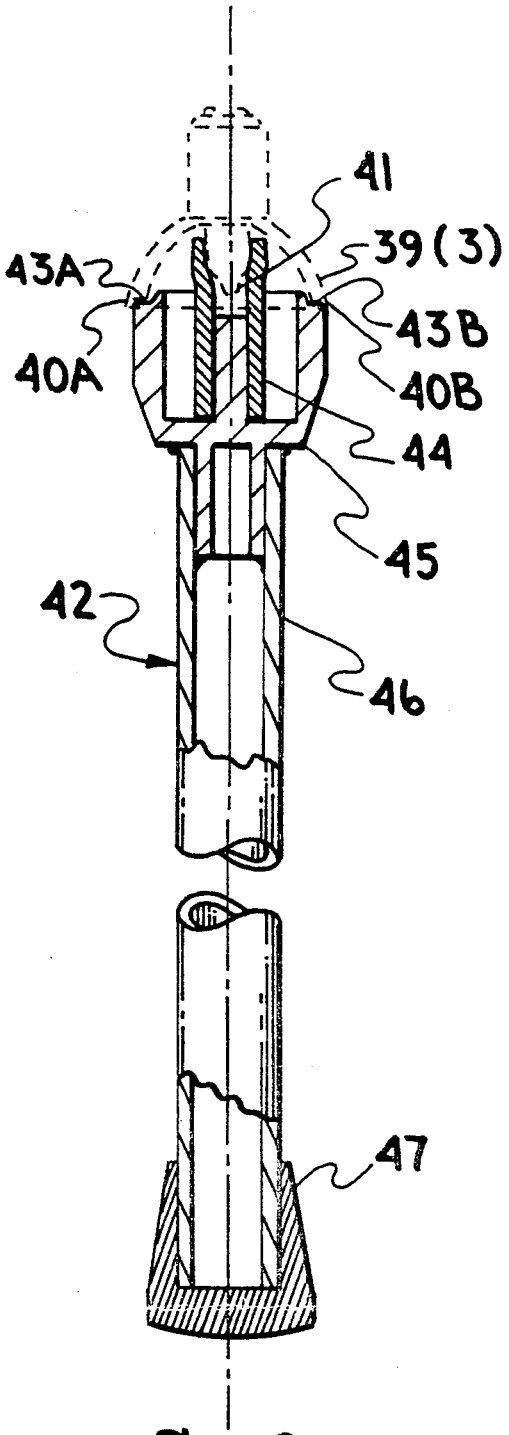
FIG. 9 is a partial cross-sectional view of a preferred embodiment of an elongated bulb removal and installation tool.

Since most ceilings are manually unreachable from the floor of a room, FIG. 9 shows a preferred embodiment of a relamping tool 42 for removal and replacement of bulb 38 (or bulb 3 of FIG. 2) including a pair of blades 43A and 43B engageable with lamp notches 40A and 40B, respectively, and a resilient tube 44 frictionally engageable with bulb 41. Tube 44 is fixed to a support 45 that is contiguous with an elongated handle 46 extending to a grip portion 47. In operation relamping tool 42 is inserted into the fixture with tube 44 engaging bulb 41 and blades 43A and 43B engaging notches 40A and 40B. respectively. The tool is rotated to release the lamp and the lamp is withdrawn from the fixture with tube 44 holding the bulb 41 (bulb 11 of FIG. 1) so the lamp 39 (lamp 3 of FIG. 1) will not fall from the tool. A new lamp may then be placed on tool 42 with the bulb held frictionally by tube 44 and lamp notches engaged onto blades 43A and 43B. The new lamp is inserted into the fixture and rotated to lock it in place. Then tool 42 is pulled loose from the bulb and the fixture is relamped.

What is claimed is:

1. A lighting fixture comprising:

a reflector lamp having a bulb, a reflector and a bayonet base;

a lampholder for holding and connecting the lamp and having a proximal end and a distal end on a central axis;

a means for connecting the lamp to an external source of electrical power through the proximal end of the lampholder;

a means for supporting the base of the lamp in the distal end of the lampholder;

a generally radial flange contiguous with the distal end of the lampholder and supporting a contiguous cylindrical bulb reflector housing coaxially with the lampholder and extending beyond the bulb reflector in the distal direction; and a means for rotationally engaging the bulb reflector for installation or removal of the bayonet base of the lamp from the lampholder including one or more notches in the reflector.

2. A lighting fixture according to claim 1 in which the notches in the reflector are engaged by a planar-bladed tool inserted into the cylindrical bulb reflector housing.

3. A lighting fixture according to claim 1 in which the notches in the reflector are engaged by a planar-bladed tool inserted into the cylindrical bulb reflector housing and said tool having a resilient tube frictionally engaging the bulb of the lamp; said tool also being provided with an elongated handle.

4. A lighting fixture according to claim 1 in which a plurality of generally planar fins are integral with the lampholder, the radial flange and the cylindrical bulb reflector housing.

5. A lighting fixture according to claim 1 in which a plurality of generally planar fins are integral with the lampholder, the radial flange and the cylindrical bulb reflector housing, and are parallel to the central axis of the lampholder.

6. A lighting fixture according to claim 1 in which a plurality of generally planar fins are integral with the lampholder, the radial flange and the cylindrical bulb reflector housing, are parallel to the central axis of the lampholder and form a parallel plane on either side of the lampholder in which a threaded transverse hole is provided.

7. A lighting fixture according to claim 1 in which:

the lampholder has a flat on either side of the central axis of the lampholder forming a parallel plane on either side of the lampholder in which a generally cylindrical fastener is provided;

a torsion spring is disposed about the cylindrical fastener and has legs resiliently biased towards the distal end of the fixture; and the cylindrical bulb reflector housing extending beyond the bulb reflector is provided with an external radial flange at its distal end; whereby the fixture may be installed in a hole in a ceiling panel that closely fits the bulb reflector housing and the legs of the torsion spring apply force to a top surface of the ceiling panel to pull the external radial flange against the bottom surface of the ceiling panel to retain the fixture in the panel.

* * * * *